US012156627B2

(12) United States Patent
Kasper

(10) Patent No.: US 12,156,627 B2
(45) Date of Patent: Dec. 3, 2024

(54) VACUUM CLEANER

(71) Applicant: BISSELL Inc., Grand Rapids, MI (US)

(72) Inventor: Gary A. Kasper, Grand Rapids, MI (US)

(73) Assignee: BISSELL INC., Grand Rapids, MI (US)

( * ) Notice: Subject to any disclaimer, the term of this patent is extended or adjusted under 35 U.S.C. 154(b) by 860 days.

(21) Appl. No.: 16/832,860

(22) Filed: Mar. 27, 2020

(65) Prior Publication Data

US 2020/0221911 A1 Jul. 16, 2020

Related U.S. Application Data

(63) Continuation of application No. 15/583,347, filed on May 1, 2017, now Pat. No. 10,610,072, which is a continuation of application No. 14/148,939, filed on Jan. 7, 2014, now Pat. No. 9,668,628.

(60) Provisional application No. 61/751,529, filed on Jan. 11, 2013.

(51) Int. Cl.

| | |
|---|---|
| ***A47L 5/34*** | (2006.01) |
| ***A47L 5/30*** | (2006.01) |
| ***A47L 9/00*** | (2006.01) |
| ***A47L 9/04*** | (2006.01) |
| ***A47L 9/16*** | (2006.01) |
| ***A47L 9/30*** | (2006.01) |

(52) U.S. Cl.

CPC ..... *A47L 5/34* (2013.01); *A47L 5/30* (2013.01); *A47L 9/009* (2013.01); *A47L 9/0411* (2013.01); *A47L 9/0477* (2013.01); *A47L 9/0494* (2013.01); *A47L 9/1616* (2013.01); *A47L 9/1683* (2013.01); *A47L 9/30* (2013.01)

(58) Field of Classification Search

CPC ..... A47L 9/066; A47L 9/2852; A47L 9/30; A47L 9/1683; A47L 9/1616; A47L 9/0494; A47L 9/0477; A47L 9/0411; A47L 9/009; A47L 5/30; A47L 5/34

USPC ..... 15/324, 368

See application file for complete search history.

(56) References Cited

U.S. PATENT DOCUMENTS

| | | | | |
|---|---|---|---|---|
| 2,482,166 | A | 9/1949 | Gage | |
| 2,641,015 | A | 6/1953 | Lovick | |
| 2,701,892 | A | 2/1955 | Mingus | |
| 3,392,418 | A | 7/1968 | Schowalter | |
| 4,138,762 | A | 2/1979 | Jost | |
| 4,903,369 | A | 2/1990 | Kitamura et al. | |
| 5,269,042 | A * | 12/1993 | Stephens | A47L 5/34 15/333 |
| 5,481,781 | A * | 1/1996 | Weber | A47L 5/30 15/422 |
| 6,237,188 | B1 | 5/2001 | Takemoto et al. | |

(Continued)

FOREIGN PATENT DOCUMENTS

| | | |
|---|---|---|
| GB | 2476812 A | 7/2011 |
| JP | 2010029661 A | 2/2010 |

(Continued)

*Primary Examiner* — Tom Rodgers

(74) *Attorney, Agent, or Firm* — McGarry Bair PC

(57) ABSTRACT

A vacuum cleaner for removing debris from a surface to be cleaned includes a suction chamber having a suction nozzle opening, a source of suction in fluid communication with the suction chamber, a brushroll provided within the suction chamber, and a roller provided in a roller chamber in front of the brushroll.

16 Claims, 7 Drawing Sheets

(56) References Cited

U.S. PATENT DOCUMENTS

| | | | | |
|---|---|---|---|---|
| 6,311,366 | B1 | 11/2001 | Sepke et al. | |
| 7,246,407 | B2 * | 7/2007 | Park | A47L 5/34 15/368 |
| 8,402,600 | B2 | 3/2013 | Beskow et al. | |
| 2005/0246857 | A1 * | 11/2005 | Omoto | A47L 9/0477 15/179 |
| 2008/0289141 | A1 * | 11/2008 | Oh | A47L 9/04 15/354 |
| 2009/0000054 | A1 * | 1/2009 | Hampton | A47L 9/00 15/323 |
| 2010/0108098 | A1 | 5/2010 | Splinter | |
| 2013/0145577 | A1 * | 6/2013 | Davidshofer | A47L 9/0477 15/300.1 |

FOREIGN PATENT DOCUMENTS

| | | | |
|---|---|---|---|
| WO | 199528121 | A1 | 10/1995 |
| WO | 199943250 | A1 | 9/1999 |
| WO | 2007074035 | A1 | 7/2007 |

* cited by examiner

VACUUM CLEANER

CROSS-REFERENCE TO RELATED APPLICATION(S)

This application is a continuation of U.S. patent application Ser. No. 15/583,347 filed May 1, 2017, now U.S. Pat. No. 10,610,072, issued Apr. 7, 2020, which is a continuation of U.S. patent application Ser. No. 14/148,939, filed Jan. 7, 2014, now U.S. Pat. No. 9,668,628, which claims the benefit of U.S. Provisional Patent Application No. 61/751,529, filed Jan. 11, 2013, which are incorporated herein by reference in their entirety.

BACKGROUND

Vacuum cleaners can include an agitator for agitating debris on a surface to be cleaned so that the debris is more easily ingested into the vacuum cleaner. In some cases, the agitator comprises a motor-driven brushroll that rotates within a base assembly or floor nozzle. Vacuum cleaners can also include a mechanism for raising or lowering the agitator relative to the surface to be cleaned, which can vary the amount of suction force applied at the surface to be cleaned.

BRIEF DESCRIPTION

An aspect of the present disclosure relates to a vacuum cleaner, comprising a base comprising an upper housing operably coupled with a lower housing and defining at least a partially enclosed space therebetween, a suction chamber provided in the lower housing, and a roller chamber forward of the suction chamber, a suction source fluidly connected to the suction chamber for generating a working air stream through the suction chamber, a first set of wheels rearward of the suction chamber, a suction nozzle opening in fluid communication with the suction chamber and defining an inlet to the suction chamber, a rotatable brushroll provided in the suction chamber for rotation about a brushroll axis, a rotatable roller mounted in the roller chamber for rotation about a roller axis, and a height adjustment mechanism provided on the base for adjusting the height of the suction chamber and the roller chamber relative to a surface to be cleaned.

An aspect of the present disclosure relates to a vacuum cleaner including a first housing comprising a suction chamber, a suction nozzle in fluid communication with the suction chamber, a roller chamber, and a passageway through the first housing, the passageway fluidly connecting the roller chamber to the suction chamber, wherein the roller chamber is defined by a curved wall and comprises an open forward portion, a passageway inlet is defined in the curved wall of the roller chamber or at the curved wall of the roller chamber and a suction source fluidly connected to the suction chamber for generating a working air stream through the suction chamber.

DETAILED DESCRIPTION

The present disclosure relates to vacuum cleaners and in particular to vacuum cleaners having an agitator assembly and a suction nozzle. In one of its aspects, the present disclosure relates to an improved suction nozzle that houses an agitator and further comprises a roller provided outside the suction nozzle and in front of the agitator. For purposes of description related to the figures, the terms "upper," "lower," "right," "left," "rear," "front," "vertical," "horizontal," and derivatives thereof shall relate to the present disclosure as oriented in FIG. 1 from the perspective of a user behind the vacuum cleaner, which defines the rear of the vacuum cleaner. However, it is to be understood that the present disclosure may assume various alternative orientations, except where expressly specified to the contrary.

Figure 1:
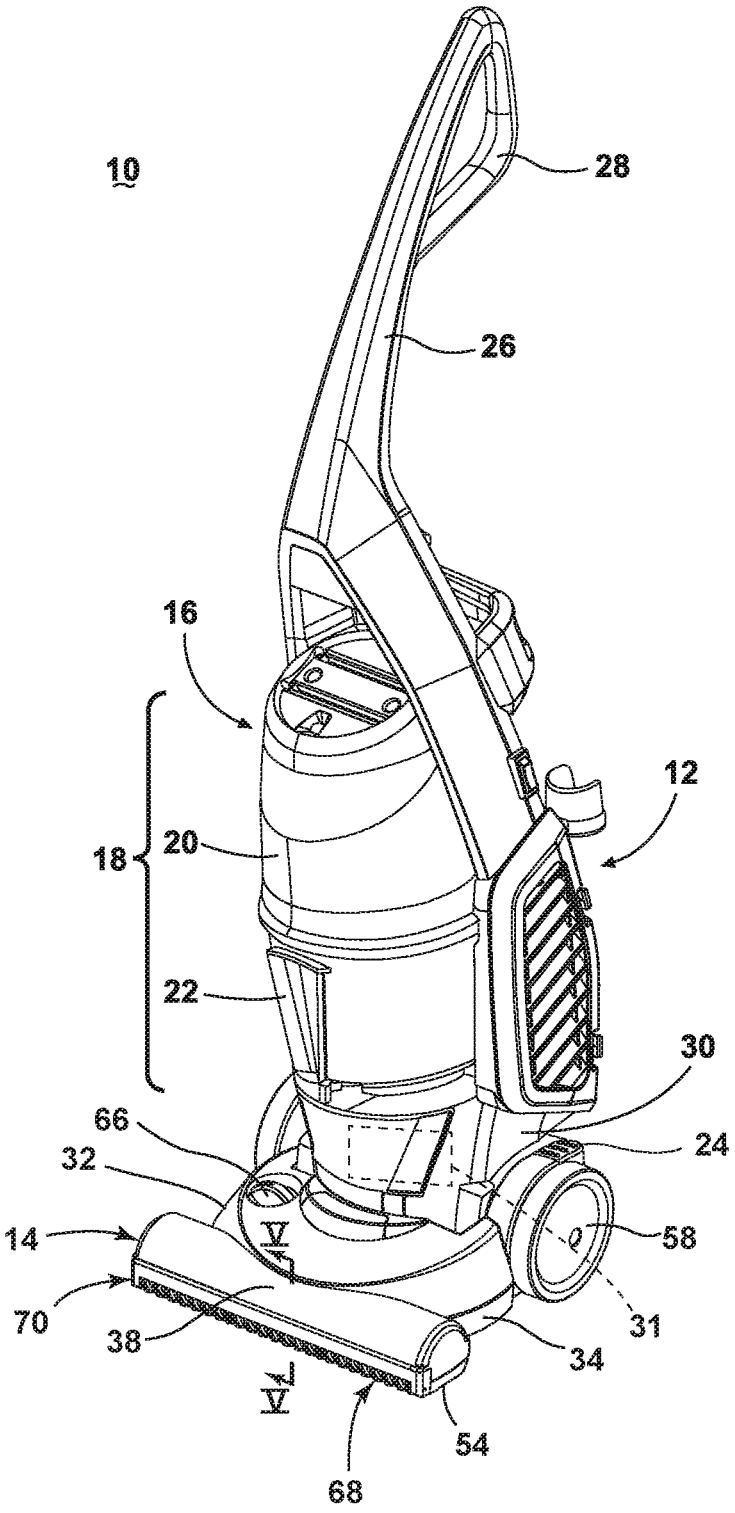
FIG. 1 is a perspective view of a vacuum cleaner according to an aspect of the present disclosure.

FIG. 1 is a perspective view of a vacuum cleaner 10 according to a first example of the present disclosure. As illustrated, the vacuum cleaner 10 comprises an upper housing 12 pivotally mounted to a lower base 14. The upper housing 12 generally comprises a main support section 16 supporting a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. The cyclone separator 20 can have a single cyclonic separation stage, or multiple stages. In another conventional arrangement, the collection system 18 can include an integrally formed cyclone separator and dirt cup, with the dirt cup being provided with a bottom-opening dirt door for contaminant disposal. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upper housing 12 is pivotally mounted to the base 14 for movement between an upright storage position, shown in FIG. 1, and a reclined use position (not shown). The vacuum cleaner 10 can be provided with a detent mechanism, such as a pedal 24 pivotally mounted to the base 14, for selectively releasing the upper housing 12 from the storage position to the use position. The details of such a detent pedal 24 are known in the art, and will not be discussed in further detail herein.

The upper housing 12 also has an elongated handle 26 extending upwardly from the main support section 16 that is provided with a hand grip 28 at one end that can be used for maneuvering the vacuum cleaner 10 over a surface to be cleaned. A motor cavity 30 is formed at a lower end of the support section 16 and contains a conventional suction source such as a motor/fan assembly 31 positioned therein in fluid communication with the collection system 18. The vacuum cleaner 10 can also be provided with one or more additional filters upstream or downstream of motor/fan assembly.

In operation, the vacuum cleaner 10 draws in dirt-laden air through the base 14 and into the collection system 18 where the dirt is substantially separated from the working air. The air flow then passes through the motor cavity 30 and past the suction source or motor/fan assembly 31 prior to being exhausted from the vacuum cleaner 10. The collection system 18 can be periodically emptied of dirt.

Figure 2:
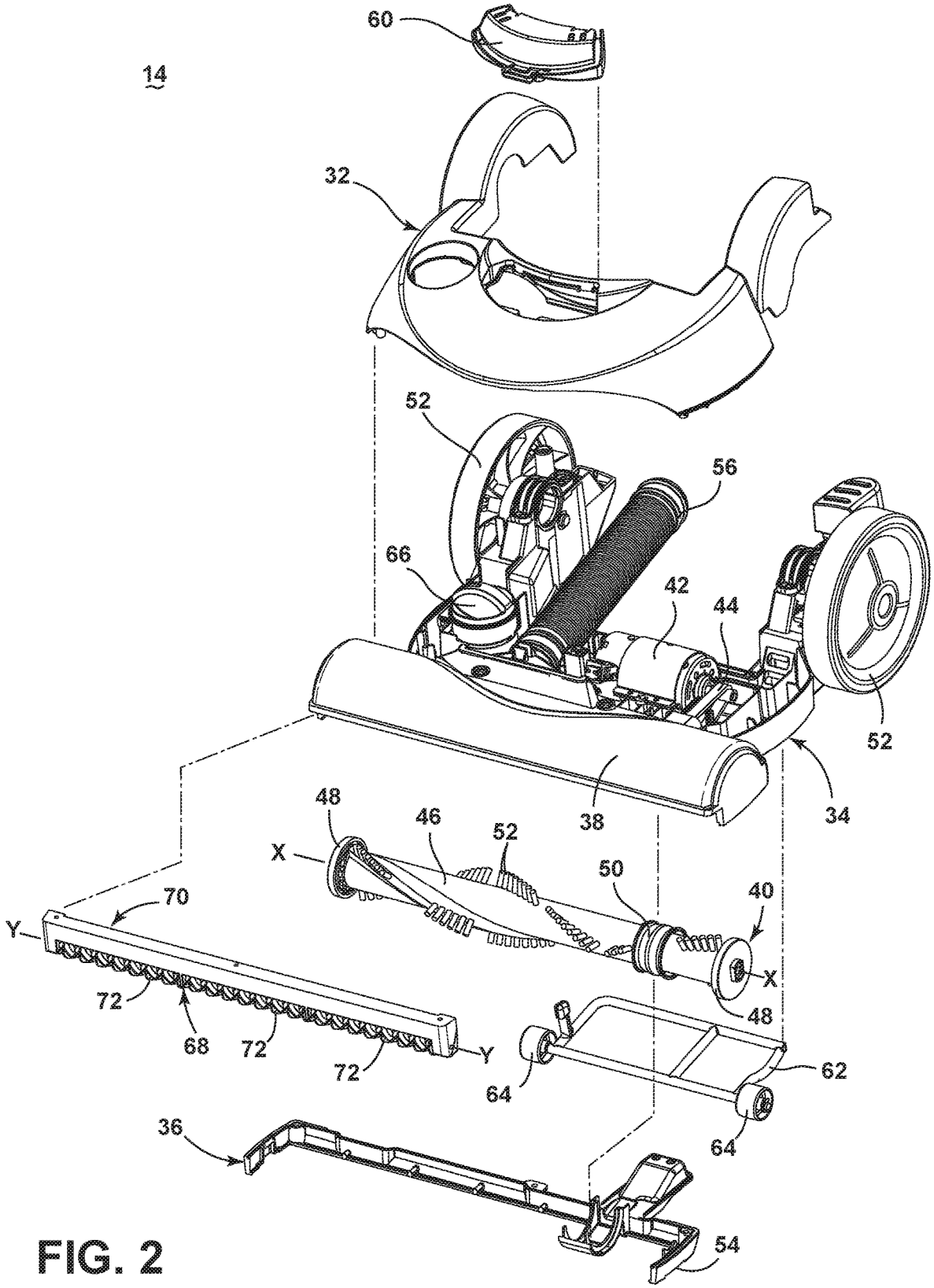
FIG. 2 is a partially exploded view of a base for the vacuum cleaner from FIG. 1.

FIG. 2 is a partially exploded view of the base 14 from FIG. 1. The base 14 includes an upper housing 32 that couples with a lower housing 34 to create a partially enclosed space therebetween. A suction chamber 38 is provided at a forward portion of the lower housing 34. As illustrated herein, the lower housing 34 can include a sole plate 36 fastened to the underside of the lower housing 34 to secure an agitator 40 within the suction chamber 38. The agitator 40 is positioned within the suction chamber 38 for rotational movement about an axis X, and can be coupled to an agitator motor 42 provided in the base 14 via a commonly known arrangement including a drive belt 44. Alternatively, the agitator 40 can be coupled to and driven by the motor/fan assembly 31 in the motor cavity 30 (FIG. 1). The agitator 40 is illustrated as a rotatable brushroll; however, it is within the scope of the present disclosure for other types of agitators to be used, such as a stationary brush or dual rotating brushrolls. Moreover, it is within the scope of the present disclosure for the agitator 40 to be mounted within the suction chamber 38 in a fixed or floating vertical position relative to the chamber 38 and lower housing 34. The agitator 40 includes a generally cylindrical brush dowel 46 with a bearing 48 on both ends and a belt engagement surface 50 around the circumference of the dowel 46 near one end that communicates with the belt 44. A plurality of bristle tufts 52 project or extend from the outer circumference of the brush dowel 46. Each bristle tuft 52 can include a plurality of flexible bristles, which may be made from a durable polymer material such as nylon or polyester, for example. The tufts 52 are arranged in a generally helix pattern in rows along the outer circumference of the brush dowel 46.

A suction nozzle opening 54 is formed in the sole plate 36 of the lower housing 34 and is in fluid communication with the suction chamber 38. A duct 56 is coupled at one end to the suction chamber 38 and fluidly communicates the suction nozzle opening 54 with the collection system 18 (FIG. 1). The suction nozzle opening 54 defines the inlet to the suction chamber 38, while the duct 56 defines the outlet from the suction chamber 38. A pair of rear wheels 58 is provided on the upper housing 32 for maneuvering the vacuum cleaner 10 over a surface to be cleaned. A headlight assembly 60 can be provided on the upper housing 32 for illuminating the surface to be cleaned in front of the suction nozzle opening 54.

The base 14 can further include an optional suction nozzle height adjustment mechanism comprising a rotatable carriage 62 attached to the lower housing 34 on which a pair of carriage wheels 64 are mounted for maneuvering the vacuum cleaner 10 over a surface to be cleaned. A rotatable knob 66 for actuating the adjustment mechanism can be provided on the exterior of the base 14. In another variation, the suction nozzle height adjustment mechanism can be eliminated.

The vacuum cleaner 10 further comprises a roller 68 provided outside the suction nozzle opening 54 and in front of the agitator 40. The roller 68 is coupled to the base 14 for free rotation about a roller axis Y that is parallel to, but spaced from, the brushroll axis X. In the illustrated example, the roller 68 is coupled to the base 14 via a roller mounting housing 70 provided on the base 14, in front of the suction nozzle opening 54. Alternatively, the roller mounting housing 70 can be formed integrally as part of the lower housing 34 or sole plate 36.

The roller 68 is not coupled with the agitator motor 42 or any other drive source, and is configured to rotate via friction created between the roller 68 and the surface to be cleaned as the base 14 is moved back and forth across the surface to be cleaned. Thus, as the base 14 is moved in a forward direction, the roller 68 rotates forwardly about the axis Y, and as the base 14 is moved in a rearward direction, the roller 68 rotates rearwardly about the axis Y.

The free rotation design of the roller 68 allows the front edge of the lower base 14 to roll over larger debris while maintaining a tight seal between the suction nozzle opening 54 and the surface to be cleaned. This action prevents "plowing" of larger debris while maintaining maximum suction inside the suction chamber 38 that effectively removes small, fine debris from the surface in addition to the larger debris.

In addition, the roller 68 can act as a third wheel set, i.e. in addition to the rear wheels 58 and front carriage wheels 64, that supports the base 14 on the surface to be cleaned for rolling movement. In another configuration (not shown), the front carriage wheels 64 can be eliminated so that the roller 68 serves as the sole front wheel set of the base 14.

The roller 68 can extend across the entire front side of the suction nozzle opening 54, but may not necessarily continuously extend. In the example illustrated herein, the roller 68 can be divided into three individual segments 72 that collectively define the roller 68. Other number of segments 72, including one, two, or more, can also make up the roller 68.

The multiple-segment roller 68 design facilitates easy turning of the base 14. For example, on a right-hand turn, the outboard left-hand segment 72 will rotate faster than the inboard right-hand segment 72. The right-hand segment 72 may even rotate backwards if the base 14 performs a pivoting turn rather than a forwardly rolling turn, thus improving maneuverability.

Forming the roller 68 in multiple segments can also provide structural rigidity. A single, long roller may flex and deflect out of contact with the surface to be cleaned, while multiple, shorter segments 72 are stiffer and will deflect less, thereby better maintaining contact with the surface to be cleaned.

Figure 3:
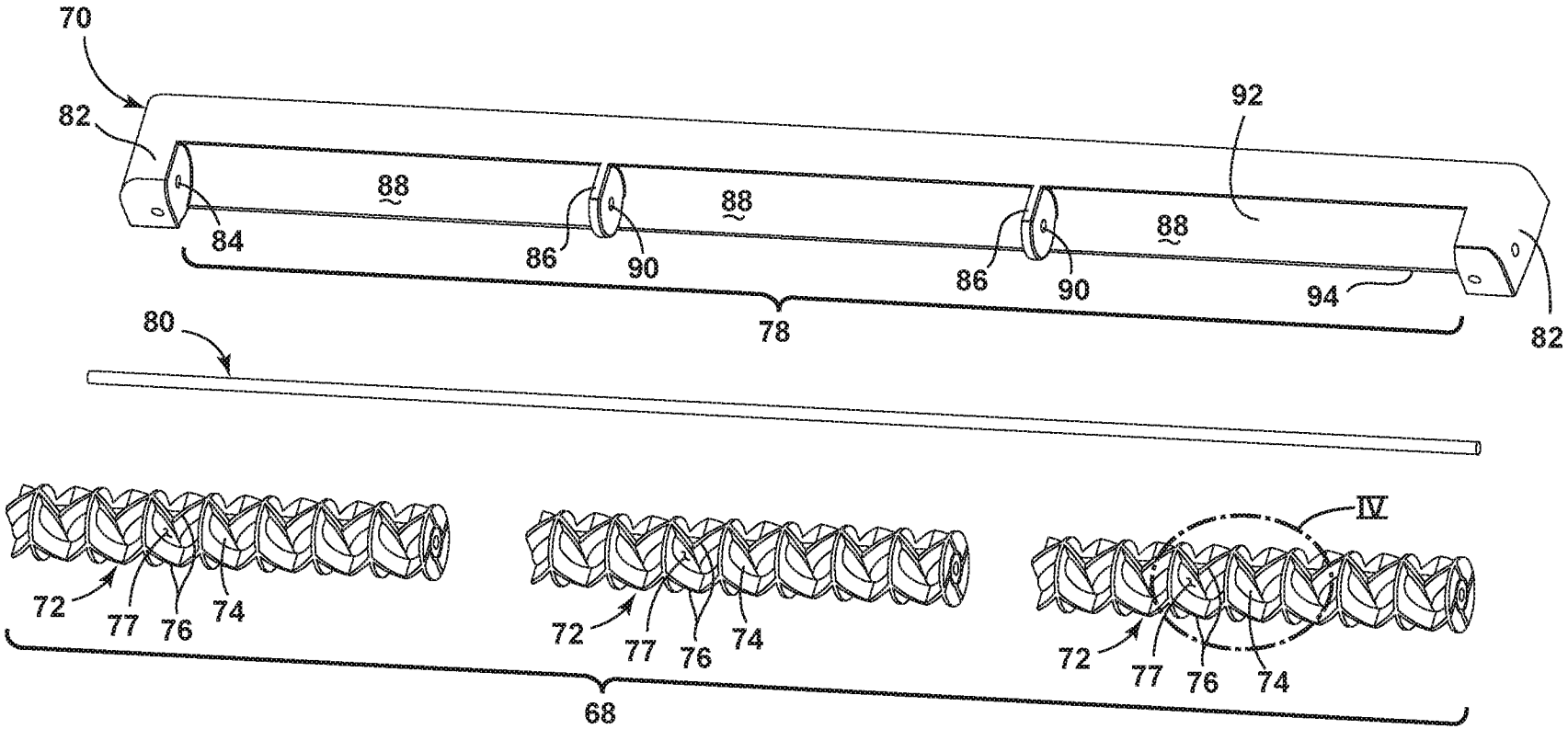
FIG. 3 is an exploded view of a roller of the base from FIG. 2.

FIG. 3 is an exploded view of the roller 68 from FIG. 2. Each segment 72 of the roller 68 comprises a cylindrical roller body 74 and one or more sealing elements shown herein in the form of paddle(s) 76 provided as elongated strips that extend or project radially from the roller body 74. Multiple paddles 76 can be provided, and can be spaced from each other about the periphery of the roller body 74 to define debris chambers 77 between adjacent paddles. The roller 68 can be a molded component, and the paddles 76 further can be integrally molded with the roller body 74.

At least the outer or floor-contacting surfaces of the roller 68 can be made from a non-marring polymeric material, such as acrylonitrile butadiene styrene (ABS) or polypropylene. In one example, roller 68 can comprise an inner substrate and an over-molded outer layer made from an elastomer. The over-molded outer layer can be selected from a material having a sufficient durometer such that the paddles 76 do not deflect when subjected to forces normally experienced during a floor cleaning operation, but would also provide sound dampening when the roller 68 is moved across hard surface flooring. In a more specific example, the substrate can be ABS and the over-molded outer layer can be thermoplastic rubber.

The roller mounting housing 70 defines a roller chamber 78 for receiving the roller 68. The roller 68 is rotatably mounted on an axle 80 fixed within the mounting housing 70 and extending through the chamber 78. The roller body 74 can be hollow in order to receive the axle 80, and can act as a hub on which the segments 72 rotate relative to the axle 80. The mounting housing 70 has two end walls 82 in which sockets 84 are provided for mounting the axle 80 in a fixed, i.e. non-rotatable, position. The mounting housing 70 can further have partition walls 86 located between the end walls 82 and dividing the roller chamber 78 into shorter chamber segments 88, each of which can receive one of the roller segments 72. The partition walls 86 can have openings 90 which allow the axle 80 to extend through the partition walls 86. While one axle 80 is used to mount all three segments 72 in the illustrated example, individual axles can be provided for each roller segment 72. The roller chamber 78 can be defined by a top wall 92 and a rear wall 94 of the mounting housing 70. The top and rear walls 92, 94 can be arcuate in shape, such that there is a close fit between the paddles 76 and the walls 92, 94. The rear wall 94 can extend downwardly over a portion of the roller 68.

In the illustrated example, the roller 68 has a fixed vertical orientation relative to the housing 70. In a version of the base 14 with a suction nozzle height adjustment mechanism, the roller 68 is always in contact with the surface to be cleaned. If the base 14 includes the suction nozzle height adjustment mechanism shown in FIG. 2, the roller 68 would be selectively raised from the surface to be cleaned as the nozzle height is increased.

Optionally, the axle 80 can be mounted to vertical slots (not shown) in the housing 70, such that the roller 68 can adjust vertically with respect to the housing 70, depending on the characteristics (i.e. carpet vs. bare floor) and height variations (i.e. deep pile vs. shallow pile) of the surface to be cleaned, and/or depending on the nozzle height set by the nozzle height adjustment mechanism shown in FIG. 2. In yet another option, the roller segments 72 can be mounted to vertical slots (not shown) in the housing 70, such that individual roller segments 72 can adjust vertically and independently of each other, depending on the characteristics and height variations of the surface to be cleaned, and/or the set nozzle height. For example, during use, one roller segment 72 may be rolled over the corner of an area rug, while another roller segment 72 is on a bare floor. In this case, the roller segment 72 over the area rug can automatically rise and the suction nozzle can accommodate both surface heights at the same time.

Figure 4:
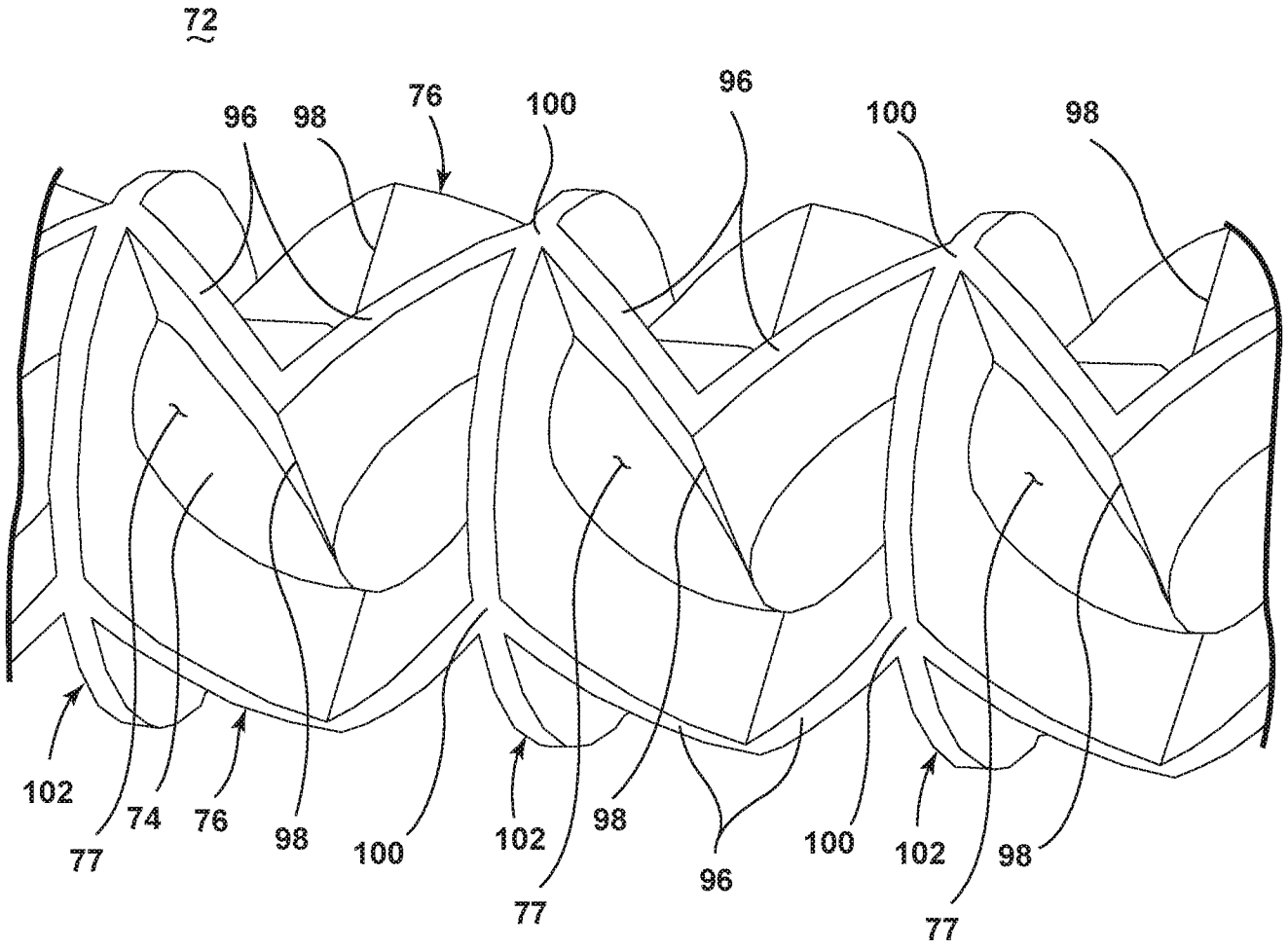
FIG. 4 is a close up view of section IV of the roller from FIG. 3.

FIG. 4 is a close up view of section IV of the roller 68 from FIG. 3. The paddles 76 can have a repeating chevron pattern, consisting of adjoining slanted blades 96 meeting at an angle to form a lower edge or point 98. Adjoining slanted blades 96 also meeting at an angle to form an upper edge or point 100. The angle between the slanted blades 96 can vary, but is illustrated as being about 90° due to tooling constraints and ease of injection molding. The repeating chevron pattern of the paddles 76 helps the roller 68 to roll smoothly over the surface of to be cleaned, since at least one of the paddles 76 is always in contact with the surface to be cleaned. This can be accomplished by having the lower points 98 of one paddle 76 aligned with or partially overlapping the upper points 100 of the adjacent paddles 76. The paddles 76 can also have different patterns which are aligned or overlapping to ensure smooth rolling.

A series of wheels 102 can also extend radially from the roller body 74, and also help ensure smooth rolling of the roller 68 over the surface to be cleaned. The wheels 102 can also act as dividers which break up the paddles 76, such that a single chevron is contained between adjacent wheels 102. As illustrated the debris chambers 77 are defined between adjacent wheels 102 and between the slanted blades 96 of adjacent paddles 76. Thus, multiple debris chambers 77 may be provided along the length as well as around the circumference of the roller 68. Absent the wheels 102 or other circumferential dividers, a single debris chamber 77 may be provided along the length the roller 68, and multiple debris chambers 77 may be provided around the circumference of the roller 68.

Figure 5:
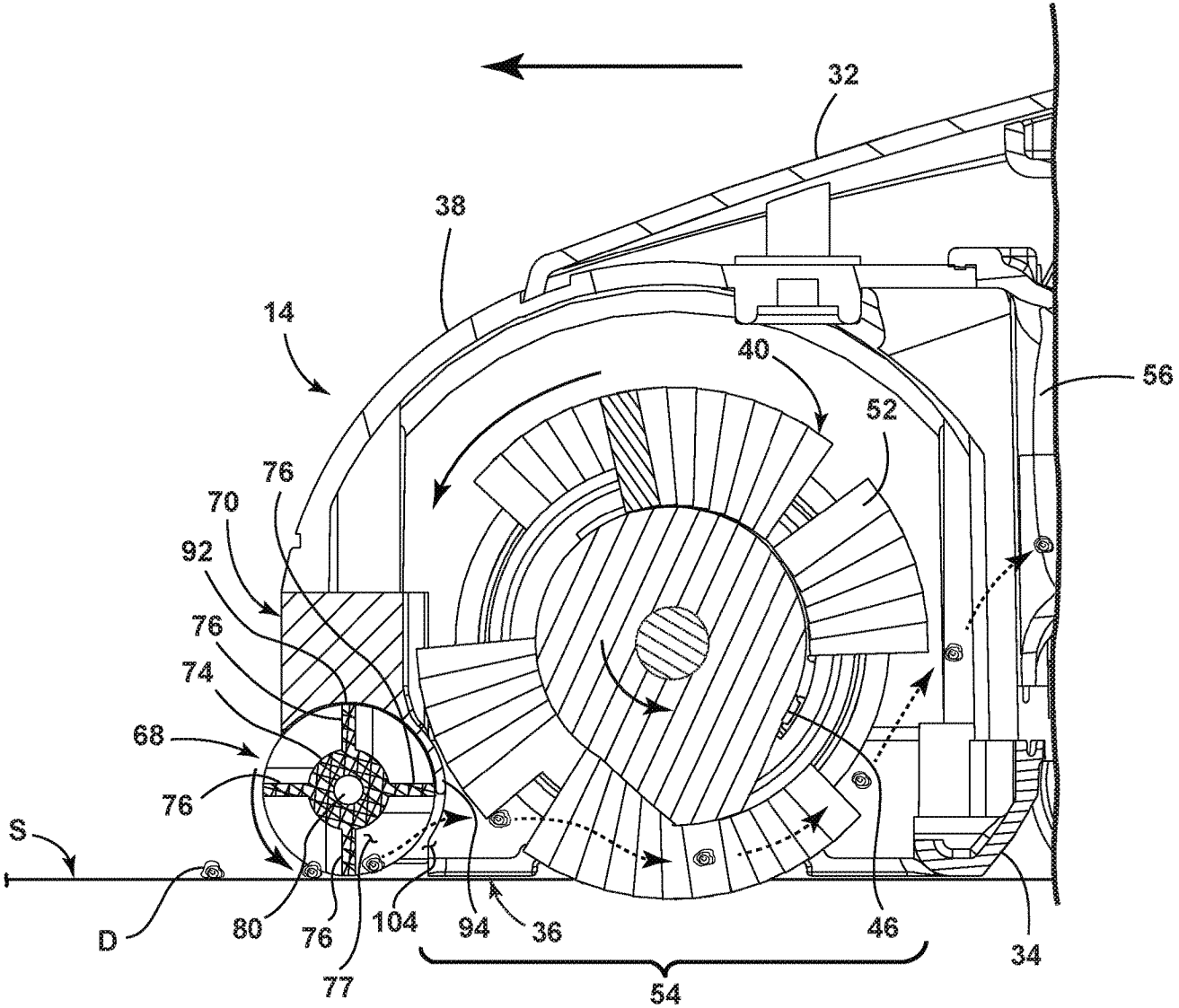
FIG. 5 is a cross-sectional view through line V-V of FIG. 1.

FIG. 5 is a cross-sectional view though line V-V of FIG. 1. The mounting housing 70 is provided on the base 14, in front of the suction nozzle opening 54, with the rear wall 94 facing the suction chamber 38. A front passageway 104 to the suction chamber 38 is formed by a gap between the rear wall 94 of the roller mounting housing 70 and the sole plate 36 of the housing 34. The front passageway 104 is in fluid communication with the suction chamber 38 and duct 56, such that dirt and debris can enter the suction chamber 38 and pass through the duct 56 via the front passageway 104.

The paddles 76 create a partial seal between the front passageway 104 and the surface to be cleaned S. The paddles 76 and mounting housing 70 are configured so that, upon the rotation of the roller about a rotational axis, the paddles 76 sequentially form a temporary seal between the passageway 104 and the surface to be cleaned S such that a corresponding debris chamber 77 is fluidly coupled to the suction chamber 38 and debris in the corresponding debris chamber 77 is ingested through the passageway 104. During use, at least one of the paddles 76 always effectively seals against the top wall 92 or rear wall 94 as the roller 68 rotates within the housing 70. The seal limits suction leaks and focuses the working air flow, which is especially helpful in picking up fine dirt and debris (not shown) which may otherwise be left behind on the surface S by the vacuum cleaner 10. In FIG. 5, the lowermost paddle 76 in contact with the surface S creates a first seal, and at least one of the uppermost paddle 76, opposite the lowermost paddle 76, and the rearmost paddle 76, which is disposed counterclockwise from the lowermost paddle 76, effectively seals off the upper portion of the roller chamber 78, so that fine dirt and debris in the lower, rear debris chamber 77 is forced through the front passageway 104, rather than being able to escape from the upper portion of the roller chamber 78. Additionally, the seal guides most of the working air to flow underneath the lowermost paddle 76 when the paddle 76 lifts off the surface to be cleaned S. Thus, a larger volume of working air is focused adjacent to surface S to lift and entrain fine debris into the suction chamber 38 and downstream collection system 18 compared to conventional vacuum cleaner suction nozzles, which have comparatively large suction leaks adjacent to the cleaning surface S. The roller 68 has the added benefit of walking over larger debris, indicated at D, allowing them into the suction chamber 38. A stationary sealing element would plow larger debris in front of the base 14, leaving them behind on the surface S.

Figure 6:
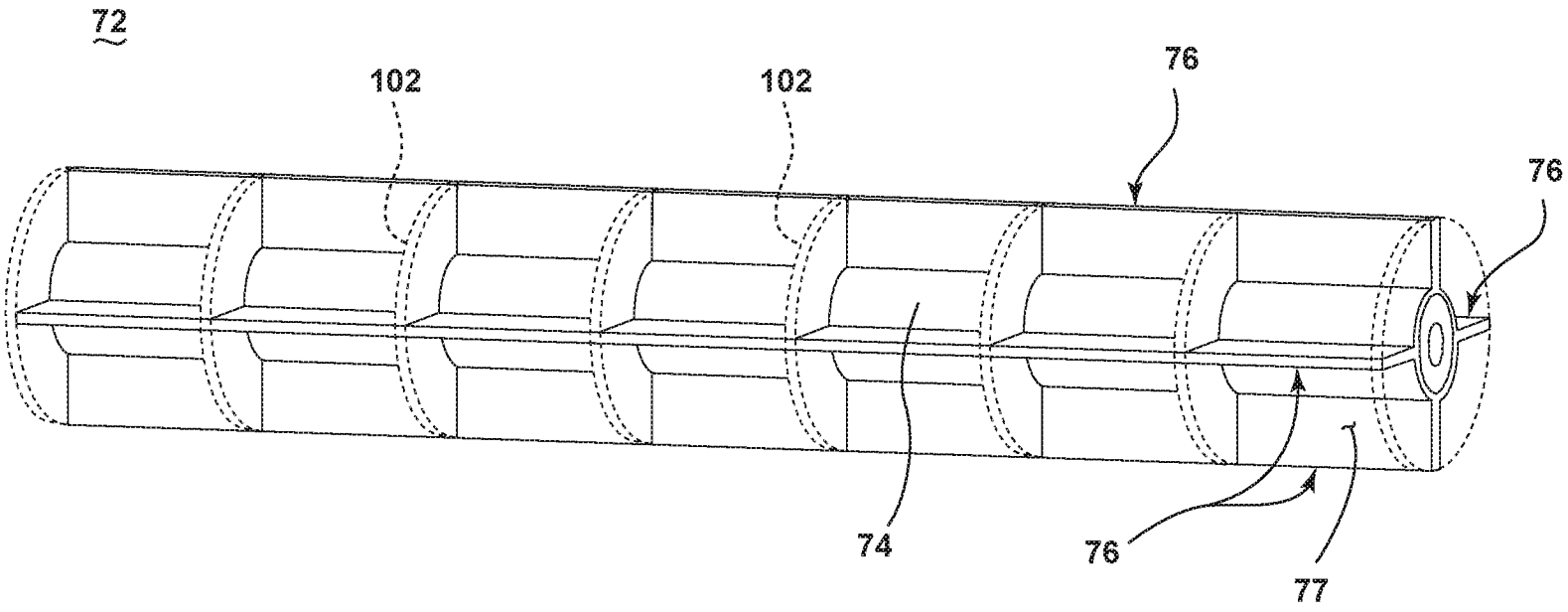
FIG. 6 is a perspective view of a roller segment according to an aspect of the present disclosure.

FIG. 6 is a perspective view of a roller segment 72 according to a second example of the present disclosure. The second example of the roller segment 72 can be used with the vacuum cleaner 10 shown in FIG. 1-5 in place of the first example of the roller segment 72. The second example of the roller segment 72 is substantially similar to the first example, with the exception that the paddles 76 are substantially flat.

Furthermore, one or more wheels 102 can optionally extend radially from the roller body 74, as indicated by the depiction of the wheels 102 in dotted line.

Figure 7:
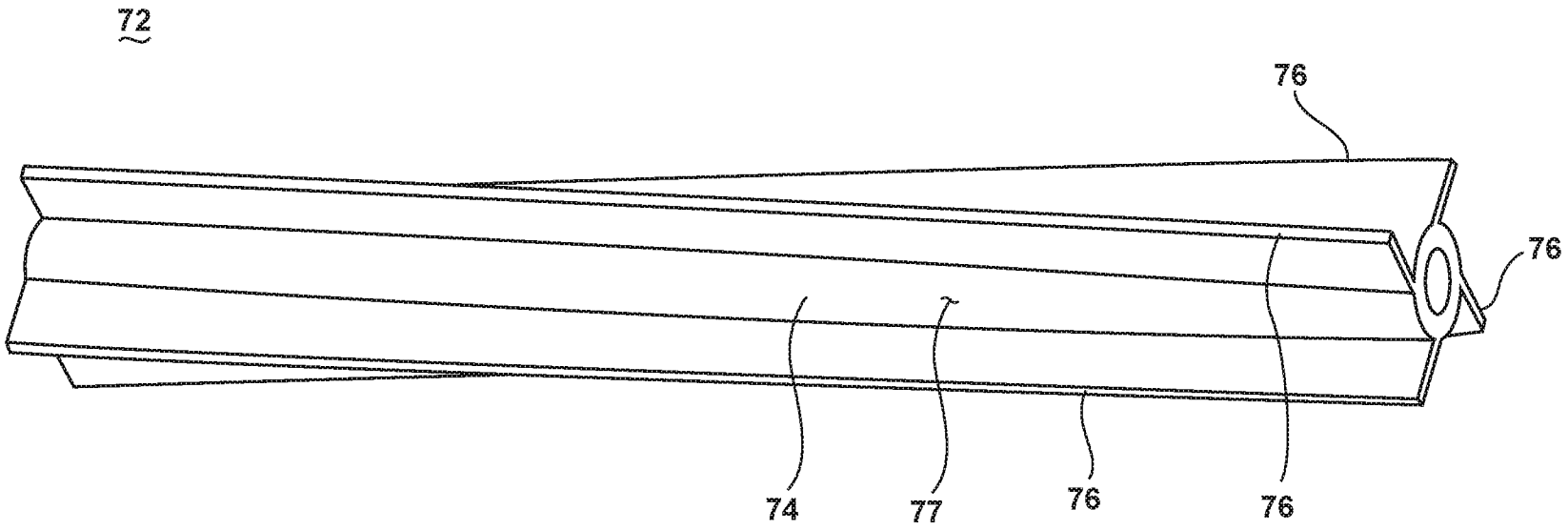
FIG. 7 is a perspective view of a roller segment according to an aspect of the present disclosure.

FIG. 7 is a perspective view of a roller segment 72 according to a third example of the present disclosure. The second example of the roller segment 72 can be used with the vacuum cleaner 10 shown in FIG. 1-5 in place of the first example of the roller segment 72. The third example of the roller segment 72 is substantially similar to the second example, with the exception that the paddles 76 are oriented at an angle so that one portion of at least one paddle 76 is always or nearly always in contact with the surface to be cleaned. Each paddle 76 extends around a portion of the circumference of the roller body 74. This helps the roller segment 72 to roll smoothly over the surface to be cleaned.

The vacuum cleaner 10 disclosed herein provides improved cleaning performance and ease of use. One advantage that may be realized in the practice of some examples of the described vacuum cleaner 10 is that the vacuum cleaner 10 can be configured to avoid plowing large debris D across the surface to be cleaned S, and will instead walk over and ingest larger debris D into the suction chamber 38 and downstream collection system 18.

Another advantage that may be realized in the practice of some examples of the described vacuum cleaner apparatus 10 is that air leaks around the suction nozzle opening 54 are minimized compared to conventional vacuum cleaner suction nozzles. Yet another advantage is that more working air flow is directed adjacent to the surface to be cleaned S to lift and entrain fine debris into the suction chamber 38 and downstream collection system 18 compared to conventional vacuum cleaner suction nozzles. Still another advantage is that some examples of the present disclosure are configured to reduce the force required to push the vacuum cleaner 10 across the surface to be cleaned S compared to conventional vacuum cleaners.

Previous nozzle designs attempted to reduce suction leaks by lowering the bottom surface of the suction nozzle towards the cleaning surface and sometimes by resting the suction nozzle on the cleaning surface during use. However, this configuration is prone to plowing debris rather than ingesting it through the suction nozzle. Additionally, when the bottom surface of the suction nozzle contacts the cleaning surface, the nozzle can dig into the cleaning surface, which can increase the force necessary to push the vacuum cleaner, which is undesirable. Raising the suction nozzle away from the cleaning surface to clear larger debris increases suction leaks and hence reduces cleaning performance.

The vacuum cleaner 10 disclosed herein avoids these issues and provides a suction nozzle opening 54 and roller 68 that reduces air leaks by maintaining a seal between the suction chamber 38 and the surface to be cleaned S, focuses working air under the bottom of the roller 68 to enhance cleaning performance, while maintaining ability to walk over and ingest larger debris D into the suction chamber 38.

While the present disclosure has been specifically described in connection with certain specific examples thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a base comprising an upper housing operably coupled with a lower housing and defining at least a partially enclosed space therebetween, a sole plate fastened to an underside of the lower housing, a suction chamber provided in the lower housing, and a roller chamber forward of the suction chamber, the roller chamber defined by a curved wall separating the roller chamber from the suction chamber, the curved wall of the roller chamber and the sole plate defining a gap therebetween, the gap forming a passageway through the base fluidly connecting the roller chamber to the suction chamber and at least partially defined by the curved wall of the roller chamber;

a suction source fluidly connected to the suction chamber for generating a working air stream through the suction chamber;

a first set of wheels rearward of the suction chamber;

a suction nozzle opening in fluid communication with the suction chamber and defining an inlet to the suction chamber;

a rotatable brushroll provided in the suction chamber for rotation about a brushroll axis, the rotatable brushroll at least partially secured by the sole plate, wherein the rotatable brushroll extends past the sole plate to a surface to be cleaned;

a rotatable roller mounted in the roller chamber for rotation about a roller axis and having a fixed vertical orientation within the base; and a height adjustment mechanism provided on the base for adjusting a height of the suction chamber relative to the surface to be cleaned.

2. The vacuum cleaner of claim 1 wherein the height adjustment mechanism includes a set of carriage wheels wherein the first set of wheels, the set of carriage wheels and the rotatable roller are configured to support the base on the surface to be cleaned.

3. The vacuum cleaner of claim 2 where the rotatable roller is selectively raised from the surface to be cleaned as the height of the suction chamber is increased via the height adjustment mechanism.

4. The vacuum cleaner of claim 1 wherein the height adjustment mechanism comprises a rotatable carriage attached to the base, a pair of carriage wheels mounted on the rotatable carriage for maneuvering the vacuum cleaner over the surface to be cleaned, and a rotatable knob for actuating the height adjustment mechanism.

5. The vacuum cleaner of claim 1 wherein the roller chamber further comprises an open forward portion.

6. The vacuum cleaner of claim 1, wherein the roller chamber further comprises an open forward portion, a passageway inlet is defined in the curved wall of the roller chamber or at the curved wall of the roller chamber.

7. A vacuum cleaner, comprising:

a first housing comprising a suction chamber, a sole plate fastened to an underside of the first housing, a roller chamber defined by a curved wall, the curved wall of the roller chamber and the sole plate defining a gap therebetween, the gap forming a suction nozzle in fluid communication with the suction chamber, the roller chamber, and a passageway through the first housing, the passageway fluidly connecting the roller chamber to the suction chamber, wherein the roller chamber comprises an open forward portion, the curved wall of the roller chamber separating the roller chamber from the suction chamber, and further wherein a passageway inlet is defined in the curved wall of the roller chamber or at the curved wall of the roller chamber;

a roller rotatably mounted and fixed horizontally within the first housing a rotatable brushroll provided in the suction chamber for rotation about a brushroll axis, the rotatable brushroll at least partially secured by the sole plate, wherein the rotatable brushroll extends past the sole plate to a surface to be cleaned; and a suction source fluidly connected to the suction chamber for generating a working air stream through the suction chamber.

8. The vacuum cleaner of claim 7, further comprising a height adjustment mechanism provided on the first housing, the height adjustment mechanism including a forward set of wheels, the height adjustment mechanism adapted for adjusting the height of the suction chamber and the roller chamber relative to the surface to be cleaned.

9. The vacuum cleaner of claim 8, wherein the roller is in engagement with the curved wall of the roller chamber.

10. The vacuum cleaner of claim 9, further comprising a second set of wheels operably coupled to the first housing and wherein the second set of wheels, the forward set of wheels and the roller are configured to support the first housing on the surface to be cleaned.

11. The vacuum cleaner of claim 9 wherein the curved wall of the roller separates the roller chamber from the suction chamber or wherein the curved wall of the roller comprises a curved top wall and a curved rear wall defining the roller chamber, wherein the curved rear wall faces the suction chamber.

12. The vacuum cleaner of claim 11 wherein the roller is in engagement with the curved top wall and the curved rear wall or at least a portion of the passageway is formed by the gap between the curved rear wall and the sole plate of the first housing.

13. The vacuum cleaner of claim 9, further comprising a roller mounting housing provided on the first housing in front of the suction nozzle opening, wherein the roller mounting housing defines the roller chamber.

14. The vacuum cleaner of claim 9 wherein the roller comprises a body defining a rotational axis of the roller and having paddles that extend radially from the body or the roller is coupled to the first housing for free rotation about the rotational axis.

15. The vacuum cleaner of claim 9 wherein the roller is substantially co-extensive with the suction nozzle or the roller extends across an entire front side of the suction nozzle opening.

16. The vacuum cleaner of claim 7, further comprising a headlight assembly provided on the first housing above the suction chamber and the roller chamber for illuminating the surface to be cleaned in front of the suction nozzle opening.

* * * * *